US012187531B2

(12) United States Patent
Daikuhara et al.

(10) Patent No.: US 12,187,531 B2
(45) Date of Patent: Jan. 7, 2025

(54) WET PARTICLE STORAGE TANK

(71) Applicant: TOYOTA JIDOSHA KABUSHIKI KAISHA, Toyota (JP)

(72) Inventors: Shugo Daikuhara, Nisshin (JP); Takenori Ikeda, Owariasahi (JP); Satoshi Moriyama, Nagoya (JP); Yuta Kawamoto, Kariya (JP); Keigo Oyaizu, Kariya (JP); Suguru Nomimura, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/601,377

(22) Filed: Mar. 11, 2024

(65) Prior Publication Data

US 2024/0217729 A1 Jul. 4, 2024

Related U.S. Application Data

(63) Continuation of application No. 17/901,207, filed on Sep. 1, 2022, now Pat. No. 11,952,208.

(30) Foreign Application Priority Data

Oct. 29, 2021 (JP) ..... 2021-177350

(51) Int. Cl.
*B65D 88/66* (2006.01)

(52) U.S. Cl.
CPC ..... *B65D 88/66* (2013.01)

(58) Field of Classification Search
CPC ..... B65D 88/66; B65D 88/68
See application file for complete search history.

(56) References Cited

U.S. PATENT DOCUMENTS

| | | | | | |
|---|---|---|---|---|---|
| 2,042,739 | A | | 6/1936 | Smith | |
| 3,079,050 | A | | 2/1963 | Wahl | |
| 3,923,204 | A | * | 12/1975 | Kato | B65D 88/68 366/186 |
| 4,199,282 | A | * | 4/1980 | Johnson | B65D 88/66 366/101 |
| 4,470,524 | A | * | 9/1984 | Semenenko | B65G 65/44 92/39 |
| 5,080,264 | A | | 1/1992 | Limper | |
| 5,497,873 | A | * | 3/1996 | Hay | B65D 88/66 198/642 |
| 5,573,149 | A | | 11/1996 | Saito | |

(Continued)

FOREIGN PATENT DOCUMENTS

| | | | |
|---|---|---|---|
| JP | H07-265782 | A | 10/1995 |
| JP | 2001-096219 | A | 4/2001 |

*Primary Examiner* — Donnell A Long
(74) *Attorney, Agent, or Firm* — Oliff PLC

(57) ABSTRACT

A wet particle storage tank includes a tank body capable of storing wet particles containing particles and solvent. The tank body has an upper storage section having a supply port through which the wet particles are supplied, a lower storage section located below the upper storage section and having a discharge port through which the wet particles are discharged, and a bridge forming section provided between the upper storage section and the lower storage section. The bridge forming section facilitates formation of a bridge by the wet particles to block falling of the wet particles from the upper storage section to the lower storage section.

6 Claims, 7 Drawing Sheets

(56) References Cited

U.S. PATENT DOCUMENTS

| | | | | |
|---|---|---|---|---|
| 6,065,650 | A | 5/2000 | Horton et al. | |
| 8,585,341 | B1 | 11/2013 | Oren et al. | |
| 2001/0038051 | A1 | 11/2001 | Okabe | |
| 2002/0139814 | A1* | 10/2002 | Bird | B65D 88/66 222/413 |
| 2012/0012619 | A1 | 1/2012 | Okabe | |

* cited by examiner

COMPARATIVE EXAMPLE

| | EXAMPLE | COMPARATIVE EXAMPLE |
|---|---|---|
| SEEPAGE OF SOLVENT | NOT OBSERVED | OBSERVED |
| SPREADABILITY | ○ | × |
| DEFECT IN FORMED FILM | NOT OBSERVED | OBSERVED |

WET PARTICLE STORAGE TANK

CROSS-REFERENCE TO RELATED APPLICATION

This is a continuation of U.S. application Ser. No. 17/901,207 filed Sep. 1, 2022, which claims priority to Japanese Patent Application No. 2021-177350 filed on Oct. 29, 2021, the entire contents of the prior application(s) being incorporated herein by reference.

BACKGROUND

1. Technical Field

The disclosure relates to a wet particle storage tank.

2. Description of Related Art

For example, a storage tank for particle supply including a tank body, a rotating bar, and an air discharge port is disclosed in Japanese Unexamined Patent Application Publication No. 7-265782 (JP 7-265782 A). The tank body can store particles. The upper part of the tank body has a particle inlet, and the lower part of the tank body has a particle outlet. The rotating bar agitates the particles in the tank body. The rotation of the rotating bar curbs caking or blocking of the particle. The air discharge port is provided above the particle outlet. The particles are discharged from the particle outlet, using air discharged from the air discharge port.

SUMMARY

In the case where wet particles including particles and solvent is stored in the storage tank as described in JP 7-265782 A, a relatively large compressive stress is generated in the wet particles stored at or near the bottom of the tank body, due to the weight of the wet particles stored in the upper section. As a result, the solvent may seep from the wet particles stored at or near the bottom of the tank body, and alteration may occur in the wet particles (for example, the spreadability may be reduced).

The disclosure provides a wet particle storage tank that can curb seepage of solvent from wet particles.

A wet particle storage tank according to one aspect of the disclosure includes a tank body configured to store wet particles containing particles and a solvent. The tank body includes an upper storage section having a supply port through which the wet particles are supplied, a lower storage section located below the upper storage section and having a discharge port through which the wet particles are discharged, and a bridge forming section provided between the upper storage section and the lower storage section. The bridge forming section facilitates formation of a bridge by the wet particle to block falling of the wet particles from the upper storage section to the lower storage section.

According to the disclosure, it is possible to provide the wet particle storage tank that can curb seepage of the solvent from the wet particles.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
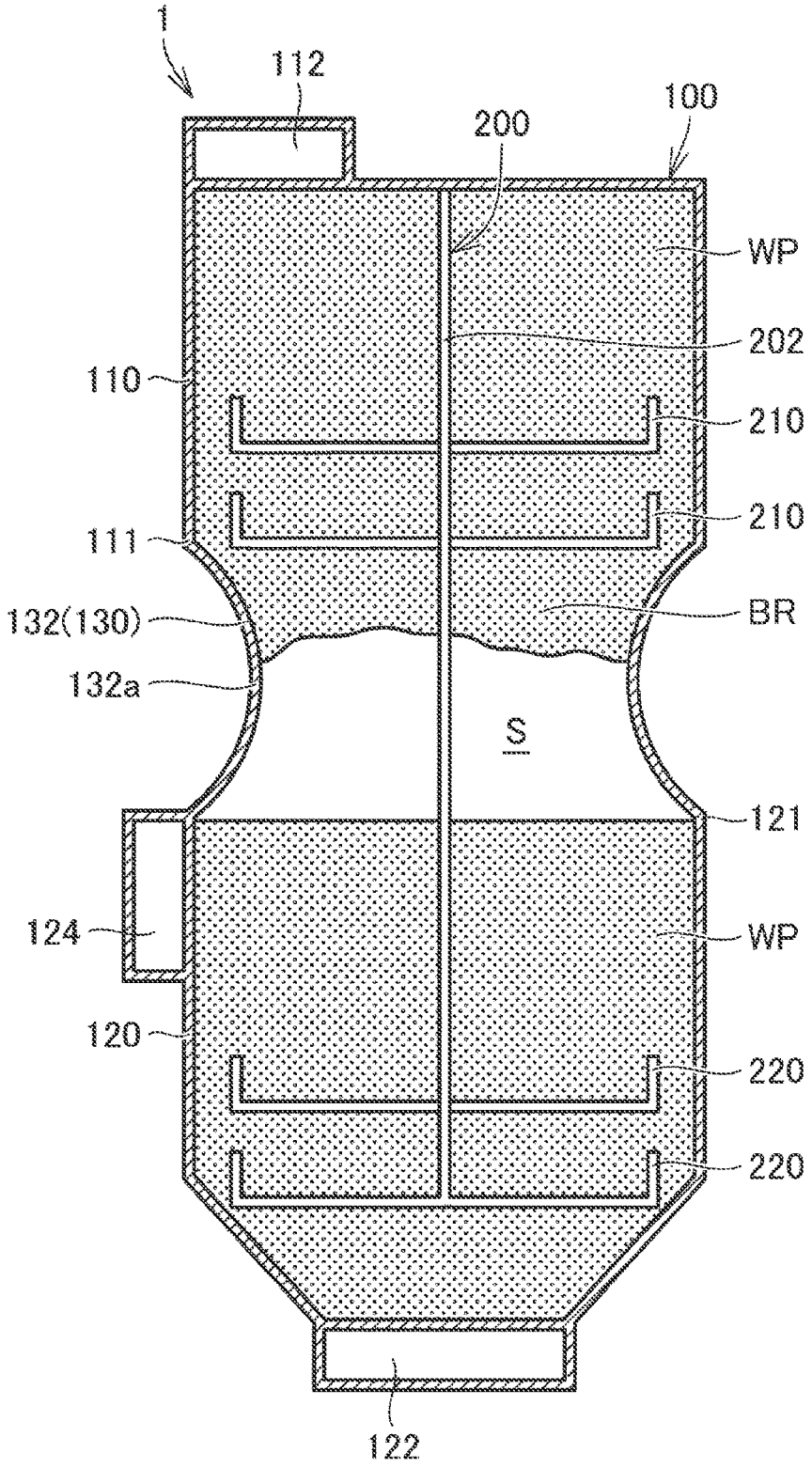
FIG. 1 is a cross-sectional view schematically showing a wet particle storage tank according to one embodiment of the disclosure.

One embodiment of the disclosure will be described with reference to the drawings. In the drawings referred to below, the same reference signs are assigned to the same or corresponding members.

FIG. 1 is a cross-sectional view schematically showing a wet particle storage tank according to one embodiment of the disclosure. The wet particle storage tank 1 is favorably used for storage of wet particles used in electrode sheets of power storage cells, for example.

The wet particle storage tank 1 includes a tank body 100 and a crushing member 200.

The tank body 100 can store wet particles WP containing particles and solvent. The solid content of the wet particles WP is, for example, between 70% and 84%. The solid content is measured by the dry weight method, for example. The wet particles WP may be granular, flaky, or clay-like. The grain size of the wet particles WP is, for example, 4 mm or less. The tank body 100 of this embodiment can store the wet particles WP in a condition where the wet particles WP are divided into the upper and lower masses. The tank body 100 has an upper storage section 110, a lower storage section 120, and a bridge forming section 130. For example, the wet particles WP are in a granular form (like wet sand) with a certain viscosity, not in a paste form. Thus, the wet particles WP do not adhere to each other and immediately fall from the upper storage section 110 to the lower storage section 120, but the wet particles WP allow the bridge forming section 130 to be formed. When the wet particles WP are pressed, the wet particles WP are brought into a state like bread dough because the wet particles WP have a certain viscosity.

The upper storage section 110 has a supply port 112 through which the wet particles WP are supplied. The supply port 112 opens upward. The upper storage section 110 is formed like a tube. More specifically, the upper storage section 110 is formed in a cylindrical shape.

The lower storage section 120 is located below the upper storage section 110. The lower storage section 120 has a discharge port 122 through which the wet particles WP are discharged. The discharge port 122 opens downward. The lower storage section 120 is formed like a tube. More specifically, the lower storage section 120 is formed in a cylindrical shape. The central axis of the lower storage section 120 is located on an extension of the central axis of the upper storage section 110. Namely, the upper storage section 110 and lower storage section 120 are formed in a cylindrical shape having the central axis extending in a direction (the vertical direction in FIG. 1) connecting the upper storage section 110 and the lower storage section 120.

A supply port 124 through which the wet particles WP are supplied may be provided on the upper part of the lower storage section 120.

The bridge forming section 130 is provided between the upper storage section 110 and the lower storage section 120. The bridge forming section 130 facilitates formation of a bridge BR (a region where the wet particles WP are stuck and solidified) (see FIG. 1) by the wet particles WP so that falling of the wet particles WP from the upper storage section 110 to the lower storage section 120 is blocked. In other words, the bridge forming section 130 forms a space S between the wet particles WP stored in the upper storage section 110 and the wet particles WP stored in the lower storage section 120.

The bridge forming section 130 has a connecting section 132 that connects the upper storage section 110 and the lower storage section 120. In this embodiment, the connecting section 132 has a neck portion 132*a*. The cross-sectional area of the neck portion 132*a* in a plane perpendicular to the above-mentioned central axis is smaller than the cross-sectional area of a lower end portion 111 of the upper storage section 110 in the plane perpendicular to the central axis, and is also smaller than the cross-sectional area of an upper end portion 121 of the lower storage section 120 in the plane. The neck portion 132*a* may be curved to be convex toward the central axis.

The crushing member 200 crushes the bridge BR formed in the tank body 100. In this embodiment, an agitator is used as the crushing member 200. The agitator has a rotating shaft 202, an upper agitator 210, and a lower agitator 220.

The rotating shaft 202 is fixed to the tank body 100 to extend along the central axis. The rotating shaft 202 can rotate about the central axis relative to the tank body 100. The rotating shaft 202 is shaped to extend from the upper end of the upper storage section 110 to the lower part of the lower storage section 120.

The upper agitator 210 is connected to a portion of the rotating shaft 202 located in the upper storage section 110. The upper agitator 210 agitates the wet particles WP in the upper storage section 110.

The lower agitator 220 is connected to a portion of the rotating shaft 202 located in the lower storage section 120. The lower agitator 220 agitates the wet particles WP in the lower storage section 120.

As described above, in the wet particle storage tank 1 of this embodiment, the bridge forming section 130 is provided between the upper storage section 110 and the lower storage section 120; therefore, the wet particles WP stored in the upper storage section 110 and the wet particles WP stored in the lower storage section 120 are separated in the vertical direction. Thus, the weight of the whole wet particles WP in the tank body 100 is restrained from acting on the wet particles WP stored at or near the bottom of the lower storage section 120, and seepage of the solvent from the wet particles WP is curbed.

Figure 2:
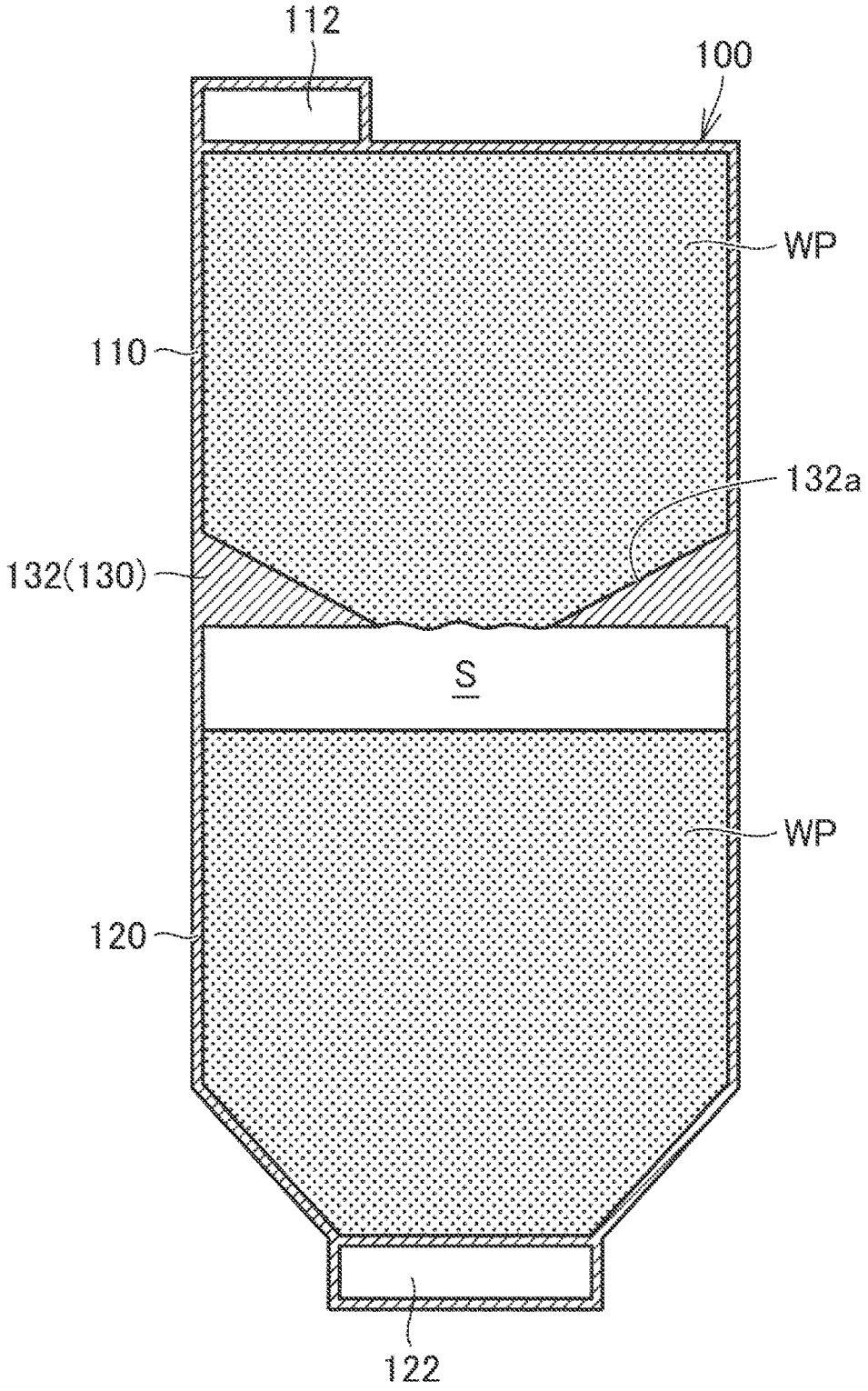
FIG. 2 is a view schematically showing a modified example of the wet particle storage tank.

In this embodiment, the neck portion 132*a* may be formed with an inclined surface such that the diameter of the neck portion 132*a* gradually decreases downward, as shown in FIG. 2.

Figure 3:
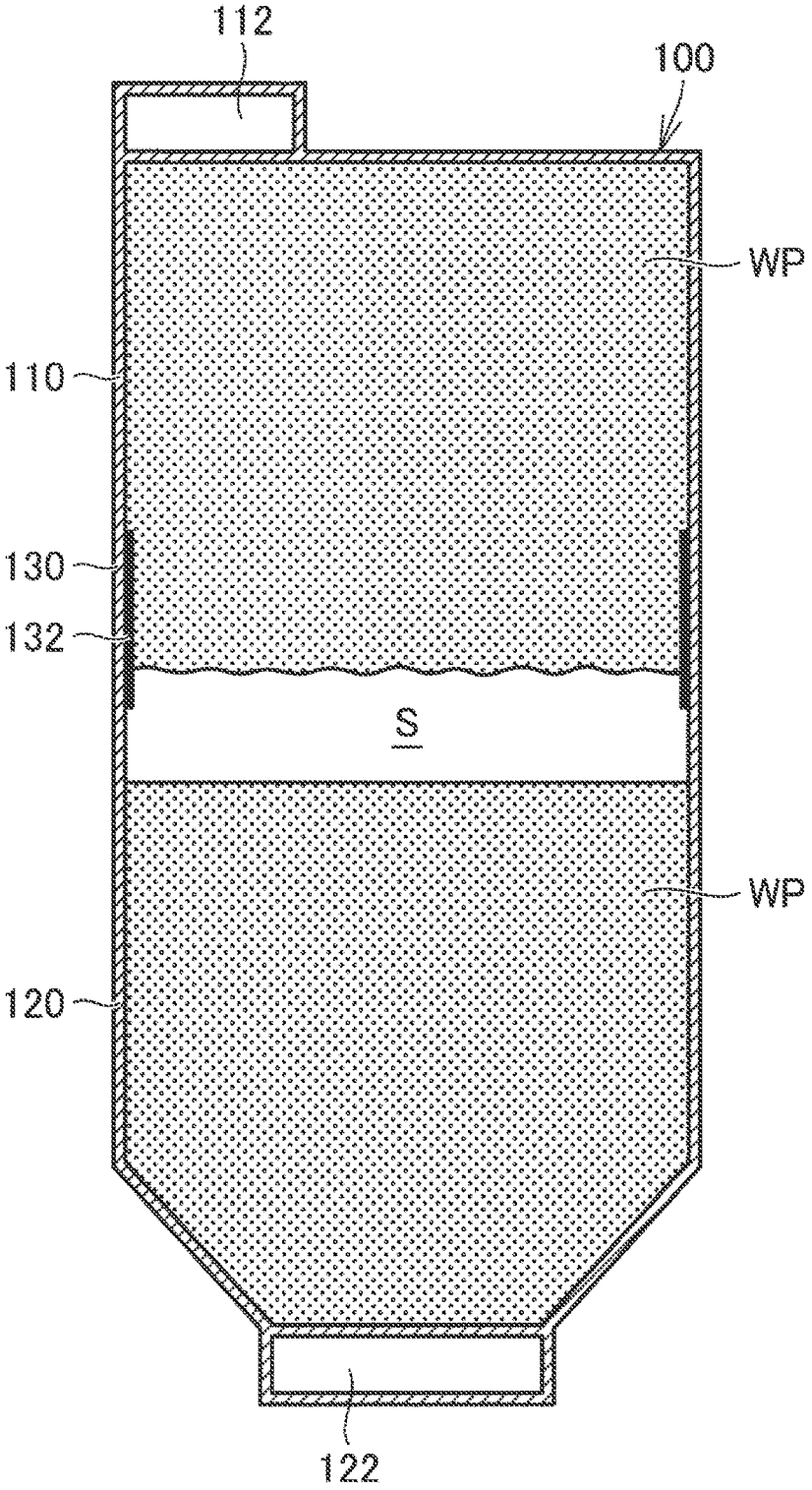
FIG. 3 is a view schematically showing a modified example of the wet particle storage tank.

As shown in FIG. 3, the connecting section 132 of the bridge forming section 130 may be formed in a cylindrical shape having the same diameter as the upper storage section 110 and the lower storage section 120. In this example, the surface roughness of the inner surface (the region indicated by thick lines in FIG. 3) of the connecting section 132 is smaller than the surface roughness of the inner surface of the upper storage section 110.

In this example, since the surface roughness of the inner surface of the connecting section 132 is smaller than the surface roughness of the inner surface of the upper storage section 110, the contact area between the wet particles WP and the connecting section 132 is larger than the contact area between the wet particles WP and the inner surface of the upper storage section 110. As a result, the friction between the wet particles WP and the inner surface of the connecting section 132 is increased, so that the bridge BR is effectively formed in the connecting section 132.

Figure 4:
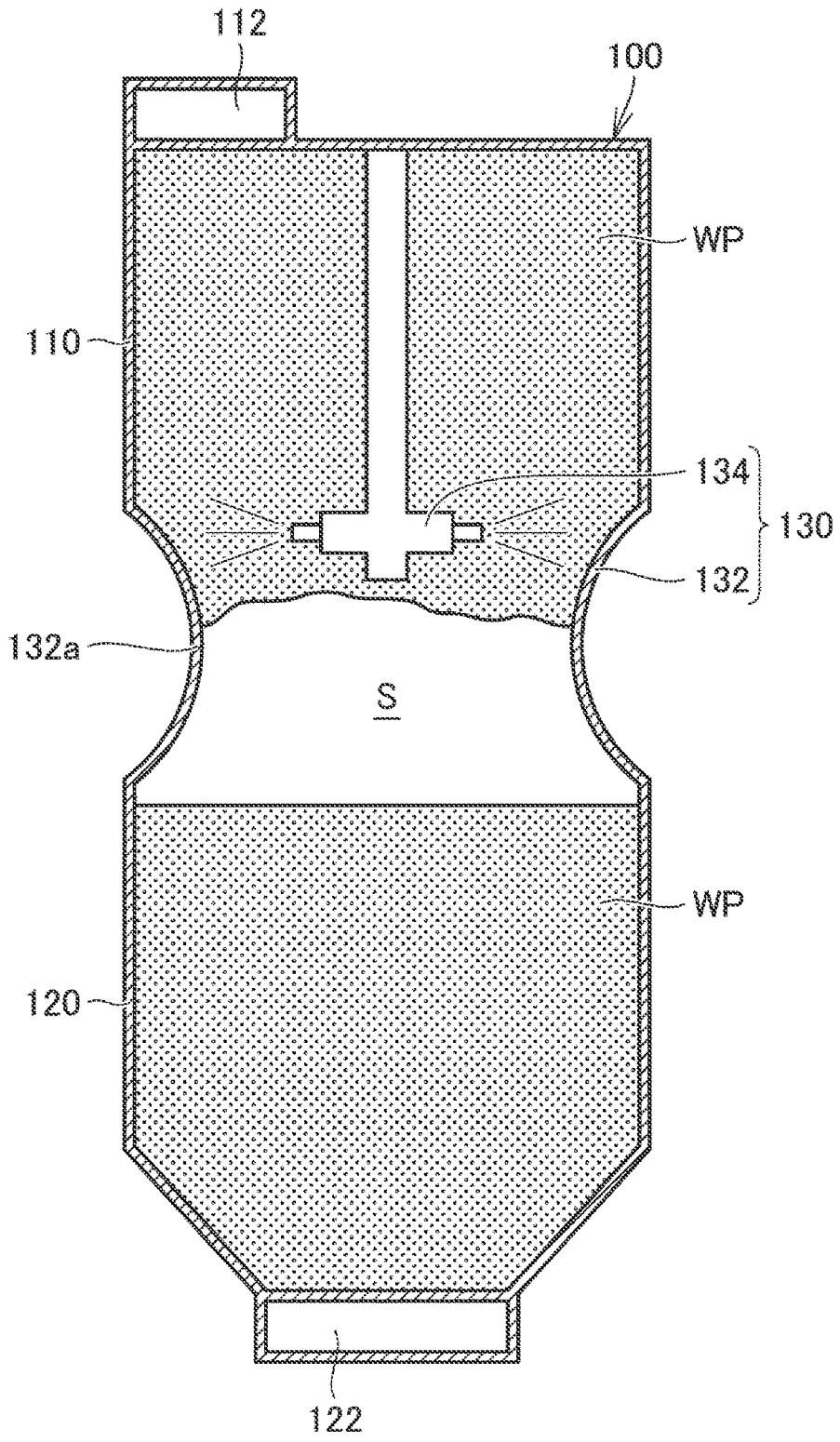
FIG. 4 is a view schematically showing a modified example of the wet particle storage tank.

As shown in FIG. 4, the bridge forming section 130 may have the connecting section 132, and a solvent supply unit 134 that supplies the solvent toward the inner surface of the connecting section 132. The solvent supply unit 134 sprays the solvent toward the inner surface of the connecting section 132 while rotating about the central axis relative to the tank body 100.

While the agitator is illustrated as an example of the crushing member 200 in the above embodiment, the crushing member 200 may be in the form of an air supply unit capable of blowing air against the bridge BR in the tank body 100, or an energy applying unit (e.g., a knocker) that applies impact energy from outside the tank body 100 to the bridge forming section 130 and its vicinity in the tank body 100.

The exemplary embodiment and modified examples described above are specific examples of the following forms.

The wet particle storage tank of the above embodiment includes the tank body capable of storing wet particles containing particles and solvent, and the tank body includes the upper storage section having the supply port through which the wet particles are supplied, the lower storage section located below the upper storage section and having the discharge port through which the wet particles are discharged, and the bridge forming section provided between the upper storage section and the lower storage section. The bridge forming section causes the wet particles to form a bridge to block falling of the wet particles from the upper storage section to the lower storage section.

In the wet particle storage tank, the bridge forming section is provided between the upper storage section and the lower storage section; therefore, the wet particles stored in the upper storage section and the wet particles stored in the lower storage section are separated in the vertical direction. As a result, the weight of the whole wet particles in the tank body is restrained from acting on the wet particles stored at or near the bottom of the lower storage section, and seepage of the solvent from the wet particles is curbed.

The upper storage section and the lower storage section may be formed in a cylindrical shape having the central axis extending in the direction connecting the upper storage section and the lower storage section. In this case, the bridge forming section may have a neck portion. The cross-sectional area of the neck portion in the plane perpendicular to the central axis is smaller than the cross-sectional area of the lower end portion of the upper storage section in the plane perpendicular to the central axis, and is also smaller than the cross-sectional area of the upper end portion of the lower storage section in the plane.

In this form, since the neck portion is formed between the upper storage section and the lower storage section, the wet particles stored in the upper storage section and the wet particles stored in the lower storage section are effectively separated in the vertical direction.

In this case, the neck portion is preferably curved to be convex toward the central axis.

With this arrangement, the wet particles are less likely or unlikely to get caught or stuck on the neck portion.

The bridge forming section may have a connecting portion that connects the upper storage section and the lower storage section. In this case, the surface roughness of the inner surface of the connecting portion is smaller than the surface roughness of the inner surface of the upper storage section.

In this form, the surface roughness of the inner surface of the connecting portion is smaller than the surface roughness of the inner surface of the upper storage section; therefore, the contact area between the wet particles and the connecting portion is larger than the contact area between the wet particles and the inner surface of the upper storage section. Thus, the friction between the wet particles and the inner surface of the connecting portion is increased, so that the bridge is effectively formed in the connecting portion.

The bridge forming section may have the connecting portion that connects the upper storage section and the lower storage section, and a solvent supply unit that supplies the solvent toward the inner surface of the connecting portion.

In this form, the proportion of the solvent in the wet power is increased in the connecting portion, so that the bridge is effectively formed in the connecting portion.

It is preferable that the wet particle storage tank further includes a crushing member that breaks down the bridge formed in the tank body.

In this form, the crushing member can crush the bridge, thus making it easy to cause the wet particles to fall from the upper storage section to the lower storage section.

For example, the crushing member includes an agitator capable of agitating the wet particles in the tank body. The agitator preferably has an upper agitator that agitates the wet particles in the upper storage section, and a lower agitator that agitates the wet particles in the lower storage section.

In this form, it is possible to achieve both the breakage of the bridge by the upper agitator, and the facilitation of discharge of the wet particles from the discharge port by the lower agitator.

Referring next to FIG. 5 to FIG. 8, the evaluation results of the wet particles in both an example of the embodiment and a comparative example will be described. The wet particles containing an active material, conductive particles, resin, and solvent was used.

Figure 5:
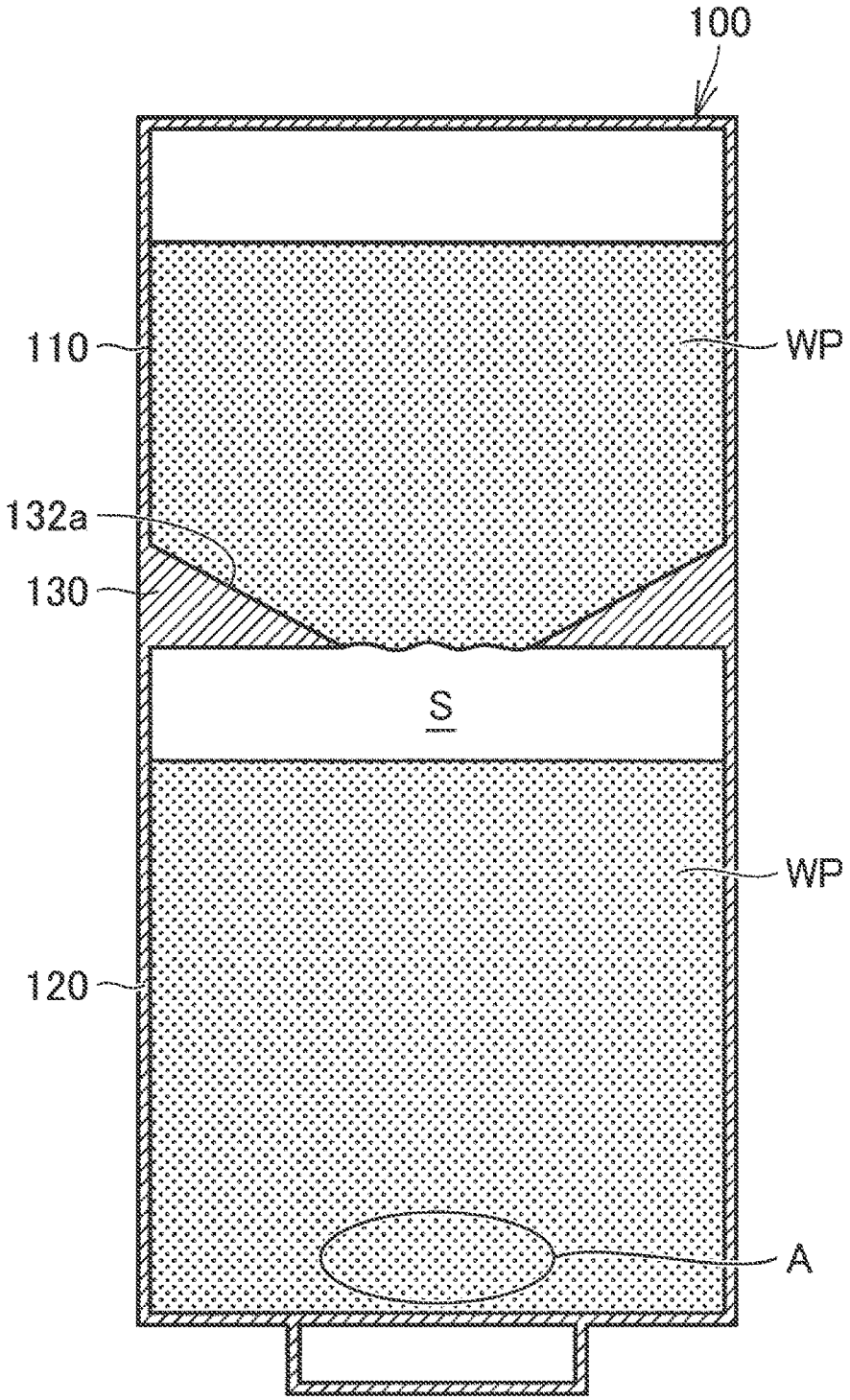
FIG. 5 is a schematic view of a wet particle storage tank used in an example of the disclosure.
Figure 6:
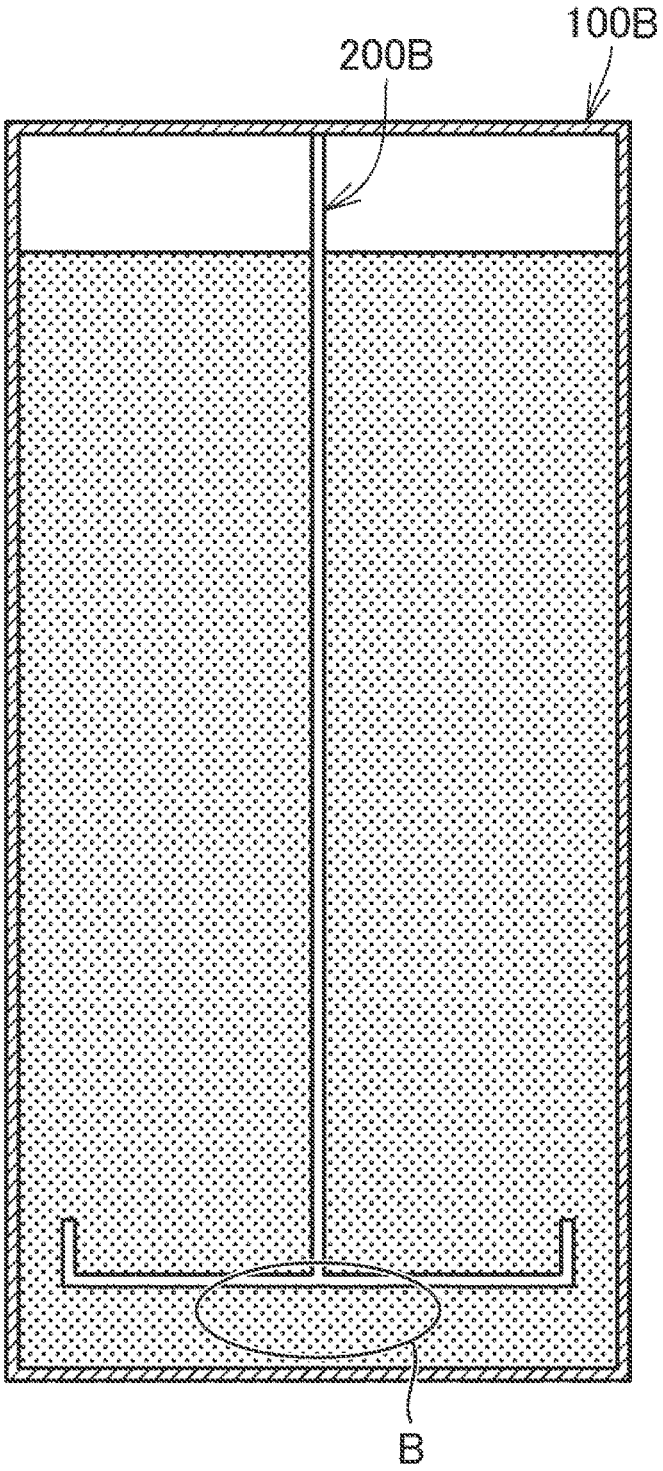
FIG. 6 is a schematic view of a wet particle storage tank used in a comparative example to the example.

FIG. 5 schematically shows a wet particle storage tank used in the example. FIG. 6 schematically shows a wet particle storage tank used in the comparative example.

As shown in FIG. 5, in the example, a tank body 100 having a neck portion 132*a* formed with an inclined surface and a diameter that gradually decreases downward, as in the example shown in FIG. 2, was used.

As shown in FIG. 6, in the comparative example, a tank body 100B formed in a cylindrical shape with a bottom was used. An agitator 200B is provided in the tank body 100B.

Figures 7, 8:
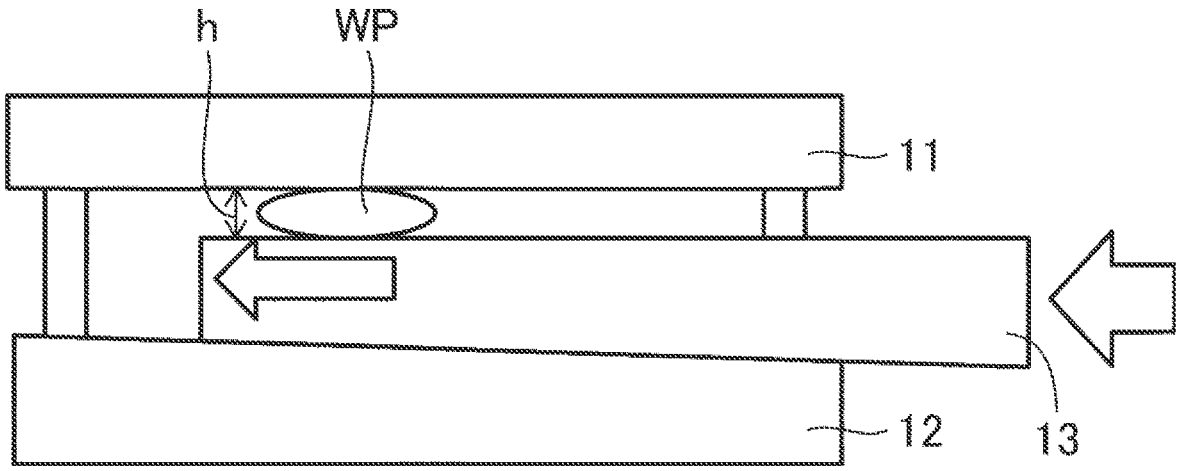
FIG. 7 is a schematic view of a device for evaluating the spreadability of the wet particles.
FIG. 8 is a table indicating various evaluation results in the example and the comparative example.

FIG. 7 schematically shows a device for evaluating the spreadability of the wet particles WP. As shown in FIG. 7, the device has an upper plate 11, a lower plate 12 located below the upper plate 11, and a middle plate 13 located between the upper plate 11 and the lower plate 12 to contact with the upper surface of the lower plate 12.

The spreadability of the wet particles WP was evaluated in the following manner. Specifically, the middle plate 13 was inserted between the upper plate 11 and the lower plate 12, as indicated by the arrow in FIG. 7, so that the spreadability was evaluated based on the distance h between the upper plate 11 and the middle plate 13 when a specified shear load was generated by the wet particles WP sandwiched between the middle plate 13 and the upper plate 11. In this connection, the upper surface of the lower plate 12 and the lower surface of the middle plate 13 that is in contact with this upper surface are inclined such that the distance between the upper plate 11 and the middle plate 13 is reduced as the middle plate 13 is inserted.

Various evaluations including the spreadability were conducted on the wet particles WP stored in a bottom part A of the tank body 100 of the example, and the wet particles WP stored in a bottom part B of the tank body 100B of the comparative example. FIG. 8 shows the evaluation results.

As shown in FIG. 8, the wet particles WP stored in the bottom part A of the example were free from seepage of the solvent, and had good spreadability (there was no alteration). When the wet particles WP were formed into films by the MPS (Moving Particle Semi-Implicit) film formation method, no defect was observed in the films thus formed.

On the other hand, the wet particles WP stored in the bottom part B of the comparative example suffered seepage of the solvent, and had poor spreadability (alteration occurred). When the wet particles WP were formed into films by the MPS film formation method, defects were observed in the films thus formed.

It is to be understood that the embodiments and examples disclosed herein are exemplary in all respects, and are not restrictive. The scope of the disclosure is defined by the claims rather than the description of the above embodiments and examples, and further includes all changes within the meaning and scope equivalent to the claims.

What is claimed is:

1. A wet particle storage tank comprising a tank body configured to store wet particles containing particles and a solvent, wherein the tank body includes:

an upper storage section having a supply port through which the wet particles are supplied;

a lower storage section located below the upper storage section and having a discharge port through which the wet particles are discharged; and a bridge forming section that connects the upper storage section to the lower storage section, the bridge forming section being configured to facilitate formation of a bridge by the wet particles to block falling of the wet particles from the upper storage section to the lower storage section, wherein a surface roughness of an inner surface of the bridge forming section is smaller than the surface roughness of an inner surface of the upper storage section.

2. The wet particle storage tank according to claim 1, wherein:

the upper storage section and the lower storage section are formed in a cylindrical shape having a central axis that extends in a direction connecting the upper storage section and the lower storage section;

the bridge forming section has a neck portion; and a cross-sectional area of the neck portion in a first plane perpendicular to the central axis is smaller than a cross-sectional area of a lower end portion of the upper storage section in a second plane perpendicular to the central axis, and is smaller than a cross-sectional area of an upper end portion of the lower storage section in a third plane perpendicular to the central axis.

3. The wet particle storage tank according to claim 2, wherein the neck portion is curved to be convex toward the central axis.

4. The wet particle storage tank according to claim 1, wherein the bridge forming section includes a solvent supply unit configured to supply the solvent toward an inner surface of the bridge forming section.

5. The wet particle storage tank according to claim 1, further comprising a crushing member configured to break down the bridge formed in the tank body.

6. The wet particle storage tank according to claim 5, wherein:

the crushing member includes an agitator configured to agitate the wet particles in the tank body, and the agitator has an upper agitator configured to agitate the wet particles in the upper storage section, and a lower agitator configured to agitate the wet particles in the lower storage section.

* * * * *